US007165407B2

(12) United States Patent
Lynch

(10) Patent No.: US 7,165,407 B2
(45) Date of Patent: Jan. 23, 2007

(54) METHODS FOR OPERATING A PULSE TUBE CRYOCOOLER SYSTEM WITH MEAN PRESSURE VARIATIONS

(75) Inventor: Nancy Jean Lynch, Tonawanda, NY (US)

(73) Assignee: Praxair Technology, Inc., Danbury, CT (US)

( * ) Notice: Subject to any disclaimer, the term of this patent is extended or adjusted under 35 U.S.C. 154(b) by 361 days.

(21) Appl. No.: 10/806,428

(22) Filed: Mar. 23, 2004

(65) Prior Publication Data

US 2005/0210886 A1 Sep. 29, 2005

(51) Int. Cl.
*F25B 9/00* (2006.01)
*F25B 49/00* (2006.01)

(52) U.S. Cl. ..... 62/6; 62/228.1

(58) Field of Classification Search ..... 62/6, 62/228.1

See application file for complete search history.

(56) References Cited

U.S. PATENT DOCUMENTS 4,745,749 A * 5/1988 Benson ..... 60/518
6,374,617 B1 4/2002 Bonaquist et al. ..... 62/6
6,604,363 B2 8/2003 Corey et al. ..... 62/6
6,640,553 B1 11/2003 Kotsubo et al. ..... 62/6
6,644,038 B1 * 11/2003 Acharya et al. ..... 62/6
6,883,333 B2 * 4/2005 Shearer et al. ..... 62/6
2006/0101836 A1 * 5/2006 Tanaka ..... 62/228.1

FOREIGN PATENT DOCUMENTS

JP 404165269 * 6/1992

OTHER PUBLICATIONS de Boer, "Optimization of the Orifice Pulse Tube". Cryogenics 40 (2000) pp. 701-711.
de Boer, "Performance of the Inertance Pulse Tube". Cryogenics 42 (2002) pp. 209-221.

* cited by examiner

*Primary Examiner*—William C. Doerrler
(74) *Attorney, Agent, or Firm*—David M. Rosenblum

(57) ABSTRACT

A method for operating a pulse tube cryocooler system wherein in the event the mean pressure of the working gas within the fixed volume of the cryocooler undergoes a change, the operation of the system is kept from severe degradation by changing the frequency of the pressure wave generator driving the cryocooler directly with the change in the mean pressure.

8 Claims, 2 Drawing Sheets

METHODS FOR OPERATING A PULSE TUBE CRYOCOOLER SYSTEM WITH MEAN PRESSURE VARIATIONS

TECHNICAL FIELD

This invention relates generally to low temperature or cryogenic refrigeration and, more particularly, to pulse tube refrigeration.

BACKGROUND ART

A recent significant advancement in the field of generating low temperature refrigeration is the pulse tube system or cryocooler wherein pulse energy is converted to refrigeration using an oscillating gas. Such systems can generate refrigeration to very low levels sufficient, for example, to liquefy helium. One important application of the refrigeration generated by such cryocooler system is in magnetic resonance imaging systems.

A pulse tube cryocooler is a hermetically-sealed, constant volume apparatus containing a fixed charge of a working gas, usually helium. To date they have typically been studied in indoor laboratory environments where there is little variation in ambient temperature. As they are commercialized and utilized in outdoor environments, or at least exposed to outdoor temperature patterns, they may experience large temperature fluctuations which could cause significant changes in the internal mean pressure since the cryocooler has constant volume and contains a fixed charge of working fluid. It has not been recognized that these mean pressure fluctuations can severely impact cryocooler performance.

Accordingly, it is an object of this invention to provide a method for operating a pulse tube cryocooler which can improve the performance of the cryocooler when the cryocooler undergoes one or more mean pressure fluctuations.

SUMMARY OF THE INVENTION

The above and other objects, which will become apparent to those skilled in the art upon a reading of this disclosure, are attained by the present invention which is:

A method for operating a pulse tube cryocooler system having a fixed volume containing working gas at a mean pressure and driven by a pressure wave generator at a frequency up to 500 hertz, said method comprising after experiencing a change in the mean pressure of the working gas, changing the frequency of the pressure wave generator directly with the change in the mean pressure of the working gas.

As used herein the term "directly" means in the same direction, i.e. an increase in mean pressure requires increasing the frequency. The changes need not be of the same magnitude and typically are not of the same magnitude.

As used herein the term "mean pressure" means the static, average or mean pressure about which the pressure oscillates.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "thermal buffer tube" means a cryocooler component separate from the regenerator and proximate the cold heat exchanger and spanning a temperature range from the coldest to the warmer heat rejection temperature for that stage.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

DETAILED DESCRIPTION

The invention encompasses the recognition that the performance of a pulse tube cryocooler can be improved by increasing the frequency of the pressure wave generator driving the cryocooler when the mean pressure of the cryocooler has experienced an increase, and also decreasing the frequency of the pressure wave generator when the mean pressure of the cryocooler has experienced a decrease.

Figure 1:
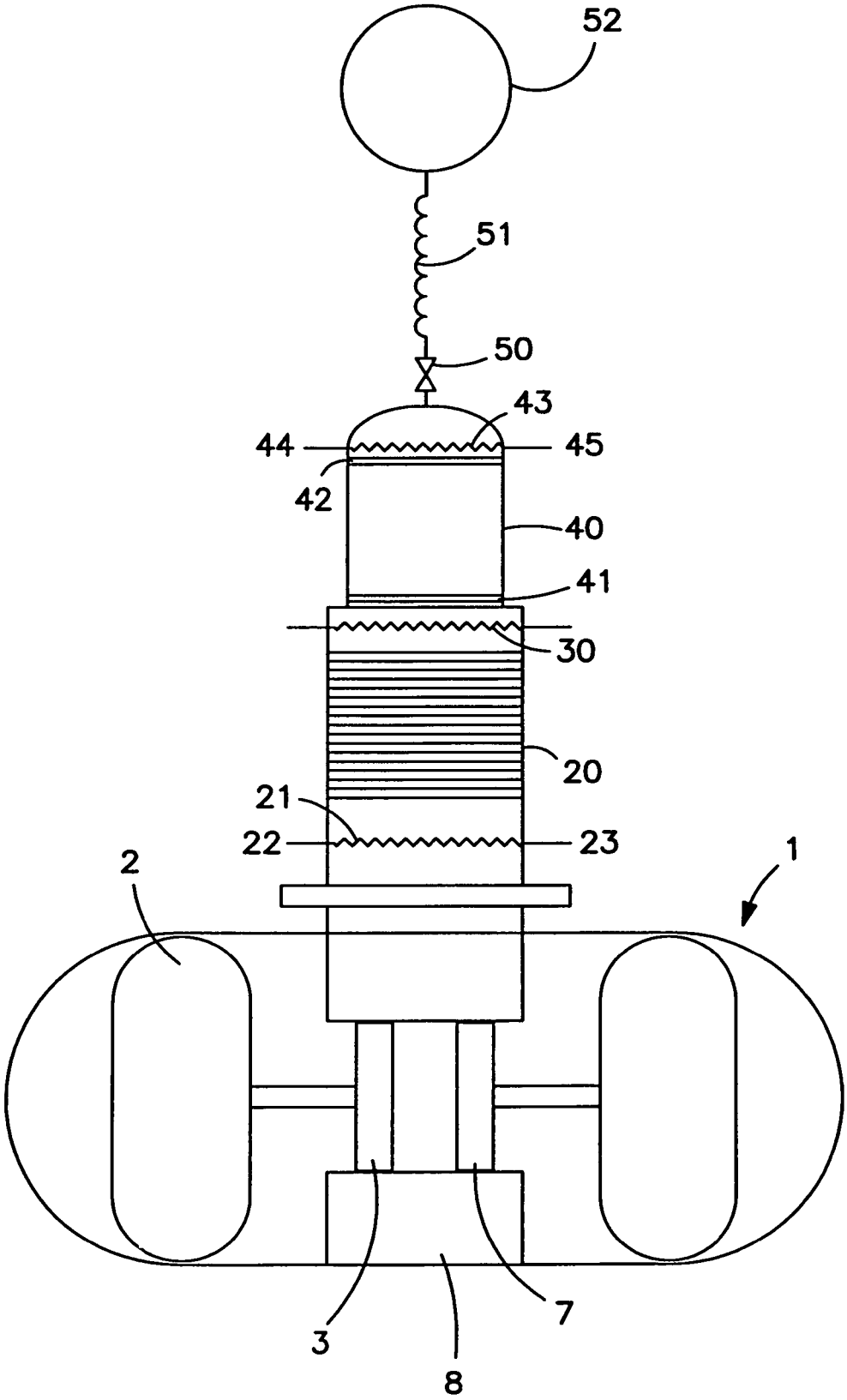
FIG. 1 is a representation of one preferred embodiment of a pulse tube cryocooler system which can benefit from the practice of this invention wherein the pressure wave generator is a linear compressor driven by an electrically driven linear motor.

The general operation of a pulse tube cryocooler system will be described with reference to the Drawings. Referring now to FIG. 1, pressure wave generator 1 may be operating at a frequency up to 500 hertz, generally within the range of from 15 to 80 hertz, and typically within the range of from 50 to 65 hertz. Pressure wave generator 1 generates a pulsing gas to drive the pulse tube cryocooler which comprises regenerator 20 and thermal buffer tube 40 which has a fixed volume and contains working gas. In the embodiment of the invention illustrated in FIG. 1, the pressure wave generator 1 is an oil-free linear compressor driven by an electrically driven linear motor, i.e. axially reciprocating electromagnetic transducer 2.

The oil-free compressor has a moving element proximate a surrounding wall. In the embodiment illustrated in FIG. 1, the moving element is piston 3 which is driven back and forth by linear motor 2. Piston 3 reciprocates within the volume defined by casing or surrounding wall 8 and is proximate surrounding wall 8 separated therefrom by clearance 7. There is no oil in clearance 7 between piston 3 and surrounding wall 8. Instead, the linear compressor employs gas bearings or flexure suspensions to ensure facile motion of piston 3.

The reciprocating piston 3 generates gas having a pulsing or oscillating motion at the frequency of the alternating current power supplied of at least 25 hertz and typically about 50 to 65 hertz. Examples of gas which may be used as the pulsing gas generated by the oil-free compressor in the practice of this invention include helium, neon, hydrogen, nitrogen, argon, oxygen, and mixtures thereof, with helium being preferred.

The pulsing gas is cooled of the heat of compression and passed to regenerator 20 of the cryocooler. Regenerator 20 is in flow communication with thermal buffer tube 40.

The pulsing gas transmits an acoustic power to the hot end of regenerator 20 initiating the first part of the pulse tube sequence. Heat exchanger 21, at the hot end of regenerator 20, is the heat sink for the heat pumped from the refrigeration load against the temperature gradient by the regenerator 20 as a result of the pressure-volume work generated by the compressor. The hot working gas is cooled, preferably by indirect heat exchange with heat transfer fluid 22 in heat exchanger 21, to produce warmed heat transfer fluid in stream 23 and to cool the compressed working gas of the heat of compression. Examples of fluids useful as the heat transfer fluid 22, 23 include water, air, ethylene glycol and the like.

Regenerator 20 contains regenerator or heat transfer media. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 20 by direct heat exchange with cold regenerator media to produce cold pulse tube working gas. With proper phasing of the pressure and velocity oscillations, the gas experiences expansion such that refrigeration is produced.

Within cold heat exchanger 30 the cold, oscillating working gas is warmed by indirect heat exchange with a refrigeration load thereby providing refrigeration to the refrigeration load. This heat exchange with the refrigeration load is not illustrated. One example of a refrigeration load is for use in a magnetic resonance imaging system. Another example of a refrigeration load is for use in high temperature superconductivity.

Thermal buffer tube 40 is used to transmit the remaining acoustic power to warmer temperatures where it may be dissipated. Preferably, as illustrated in FIG. 1, thermal buffer tube 40 has a flow straightener 41 at its cold end and a flow straightener 42 at its hot end. The acoustic power is dissipated and rejected in heat exchanger 43, orifice 50, inertance line 51, and reservoir 52. FIG. 1 shows an inertance network including all of these elements, but in practice, one or more (specifically the orifice 50 or inertance line 51) may be eliminated. Note that in addition to dissipating acoustic power, the inertance network provides for proper phasing between the pressure and velocity amplitudes of the working, oscillating gas. Other means for maintaining the pressure and flow waves in phase which may be used include inertance tube and orifice, expander, linear alternator, bellows arrangements, and a work recovery line connected back to the compressor with a mass flux suppressor.

Cooling fluid 44 is passed to heat exchanger 43 wherein it is warmed or vaporized by indirect heat exchange with the working gas, thus serving as a heat sink to cool the compressed working gas. Resulting warmed or vaporized cooling fluid is withdrawn from heat exchanger 43 in stream 45. Preferably cooling fluid 44 is water, air, ethylene glycol or the like.

The following example and comparative example serve to illustrate the invention and highlight the advantages attainable with the invention. The examples are presented for illustrative purposes and are not intended to be limiting.

A pulse tube cryocooler system was optimized for operation at 2.6 MPa near 60 hertz. For a design at 70° F., a cryocooler exposed to outdoor ambient temperatures could potentially experience the following mean pressure variations. There may be other factors which might cause the operating pressure to deviate from the design pressure, such a slow loss of helium over time due to a small leak, or errors in pressurizing the cryocooler prior to operation.

| Condition | Temperature, ° F.(C.) | Mean Pressure MPa |
|---|---|---|
| Cold Ambient | 30° F. (−1° C.) | 2.4 MPa |
| Design Conditions | 70° F. (21° C.) | 2.6 MPa |
| Hot Ambient Conditions | 110° F. (43° C.) | 2.8 MPa |

Simulations were generated to determine the effect of mean pressure variation on cryocooler performance. Since changing the temperature at which heat is rejected will also impact cryocooler performance, the heat rejection temperature was not varied so that the impact of mean pressure could be studied directly. Further, the pressure wave generator was assumed to be operating at full capacity at the design point, meaning that it was simultaneously maintained at full stroke and current limitations.

Figure 2:
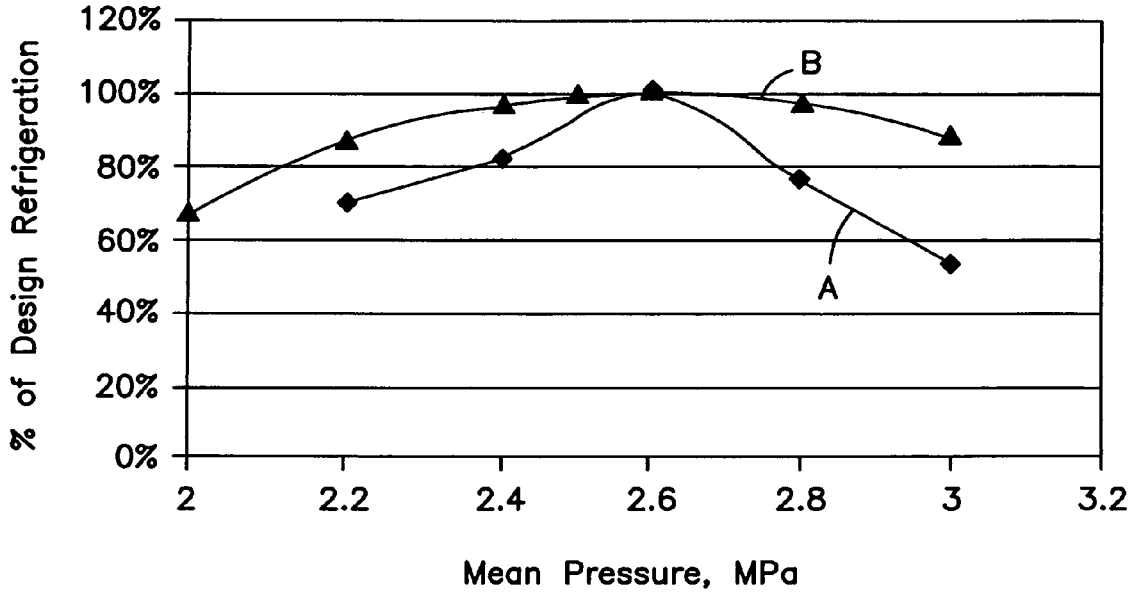
FIG. 2 is a graphical representation of the results of examples and comparative examples of the invention and without the practice of the invention.

Curve A of FIG. 2 illustrates how the predicted cryocooler performance can be influenced by mean pressure fluctuations. In this example, the pressure wave generator is operating at a single frequency, and is fully optimized and operating at full capacity; i.e. it is near both stroke and current limitations. As the pressure falls, the input power must be reduced in order to continue operating within stroke limitations. Similarly, as pressure is increased the stroke will fall but no more power can be supplied because the cooler is already operating at the maximum allowable current. Cryocooler refrigeration capacity falls primarily because the power supplied to the cryocooler decreases to keep it within prescribed stroke and current limitations. As the pressure deviates from the design pressure and power input falls, the cryocooler performance decreases.

However, with the use of this invention, one can compensate for changes in mean pressure by adjusting the frequency of the pressure wave generator. If the mean pressure falls, the frequency is decreased to the point that the pressure wave generator is again operating at full current and stroke. In this manner power input to the pressure wave generator is maximized, and this provides the best means to maximize the refrigeration produced by the cryocooler. Curve B of FIG. 2 shows the predicted cryocooler performance when the frequency is so adjusted and demonstrates a significant performance improvement.

In order to implement this invention, the user must have some means of varying the electric power feed's frequency and voltage independently. One practical and cost-effective means is a variable frequency drive which has been modified to allow voltage and frequency to be independently controlled. Three phase, incoming feed at 50 to 60 hertz electric power is connected to the variable frequency drive electronics package. Two legs of the three phase output are then connected to the motor leads, while the third output leg remains unconnected. In one mode, the user can manually set the desired frequency and input power voltage by direct interaction with VFD or other drive electronics operator interface, which might be a keyboard, a potentiometer or other device. In other modes, the frequency and/or voltage could be determined by a controller which sends an appropriate signal to the variable frequency drive. In one mode, the mean pressure could be determined via a sensor, and the controller could adjust the frequency according to an internal relationship between mean pressure and frequency.

Although the invention has been described in detail with reference to certain preferred embodiments, those skilled in the art will recognize that there are other embodiments of the invention within the spirit and the scope of the claims.

The invention claimed is:

1. A method for operating a pulse tube cryocooler system having a fixed volume containing working gas at a mean pressure and driven by a pressure wave generator at a frequency up to 500 hertz, said method comprising after experiencing a change in the mean pressure of the working gas, changing the frequency of the pressure wave generator directly with the change in the mean pressure of the working gas.

2. The method of claim 1 wherein the change in the mean pressure is due to a change in ambient temperature.

3. The method of claim 1 wherein the change in the mean pressure is due to a loss of working gas from the fixed volume.

4. The method of claim 1 wherein the change in the mean pressure is an increase in the mean pressure and the change in the frequency of the pressure wave generator is an increase in the frequency of the pressure wave generator.

5. The method of claim 1 wherein the change in the mean pressure is a decrease in the mean pressure and the change in the frequency of the pressure wave generator is a decrease in the frequency of the pressure wave generator.

6. The method of claim 1 wherein the pressure wave generator is a linear compressor driven by an electrically driven linear motor.

7. The method of claim 1 wherein the working gas comprises helium.

8. The method of claim 1 wherein the pressure wave generator is operating at a frequency within the range of from 15 to 80 hertz.

* * * * *